United States Patent [19]

Nippert

[11] 4,416,141

[45] Nov. 22, 1983

[54] METHOD AND APPARATUS FOR FORMING AN ELECTRICAL CONNECTOR

[75] Inventor: Russell A. Nippert, Delaware, Ohio

[73] Assignee: The Nippert Company, Delaware, Ohio

[21] Appl. No.: 338,804

[22] Filed: Jan. 11, 1982

[51] Int. Cl.[3] ..... B21D 22/00

[52] U.S. Cl. ..... 72/345; 72/356; 72/377

[58] Field of Search ..... 72/344, 345, 354, 356, 72/358, 359, 377

[56] References Cited

U.S. PATENT DOCUMENTS

| | | | |
|---|---|---|---|
| 1,702,278 | 2/1929 | Simons. | |
| 2,583,270 | 1/1952 | Lynall | 10/11 |
| 2,891,298 | 6/1959 | Kaul. | |
| 3,101,534 | 8/1963 | Lange | 72/356 |
| 3,122,831 | 3/1964 | Bailey | 72/356 |
| 3,186,209 | 6/1965 | Friedman | 72/356 |
| 3,188,849 | 6/1965 | Wisebaker | 72/356 |
| 3,197,857 | 8/1965 | Nippert | 29/480 |
| 3,494,168 | 2/1970 | Williamson | 72/335 |
| 3,589,164 | 6/1971 | Constant | 72/354 |
| 4,061,013 | 12/1977 | Kuc | 72/358 |
| 4,071,947 | 2/1978 | Nippert | 29/624 |
| 4,166,373 | 9/1979 | Braun | 72/359 |
| 4,238,949 | 12/1980 | Roper | 72/358 |
| 4,291,568 | 9/1981 | Stifano | 72/356 |

FOREIGN PATENT DOCUMENTS

| | | |
|---|---|---|
| 1402775 | 10/1968 | Fed. Rep. of Germany. |
| 778466 | 7/1957 | United Kingdom. |
| 1584292 | 2/1981 | United Kingdom. |

*Primary Examiner*—Leon Gilden
*Attorney, Agent, or Firm*—Biebel, French & Nauman

[57] ABSTRACT

A method and apparatus for forming an electrical connector having a first hollow cylindrical portion of a first outside diameter and a second hollow cylindrical portion of a second outside diameter which is less than the first outside diameter, are provided in which two successive extrusion operations are performed. In the first extrusion operation, a billet of ductile metal is placed in a first die and an intermediate billet is formed by back extruding the first portion of the connector over a punch while forward extruding a part of the billet in the die to form a portion of reduced diameter approximately equal to the second outside diameter of the electrical connector. In the second extrusion operation, the intermediate billet is placed in a movable die section and the intermediate billet and the movable die section are moved downward from an initial position by means of a finish punch. The finish punch contacts the intermediate billet and is received within a first cylindrical recess defined by the billet. Downward movement of the movable die section forces the portion of reduced diameter of the intermediate billet over a stationary punch, thus forward extruding the second cylindrical portion of the connector. The finish punch is then retracted from the connector, and the connector is ejected from the movable die section by raising the stationary punch with respect to the movable die section.

14 Claims, 7 Drawing Figures

METHOD AND APPARATUS FOR FORMING AN ELECTRICAL CONNECTOR

BACKGROUND OF THE INVENTION

The present invention relates to a method and apparatus for making an elongated cylindrical article from a billet of ductile metal and, more particularly, a method and apparatus for forming an electrical conductor. The electrical connector has a first cylindrical portion with a first outside diameter, the first cylindrical portion defining a first cylindrical recess therein, and a second cylindrical portion with a second outside diameter, the second cylindrical portion defining a second cylindrical recess therein. The second outside diameter is less than the first outside diameter.

The manufacture of articles of a ductile metal, such as copper or a copper alloy, has in the past been accomplished by various techniques, such as cold forming, machining, and extruding. U.S. Pat. No. 3,197,857, issued Aug. 3, 1965, to Nippert, discloses a method of making a cup-shaped housing of copper or copper alloy. A workpiece of copper material, having a weld ring brazed thereon, is placed in a confining die and subjected to pressure by a downwardly advancing male die portion, causing back-flow of the ductile metal along the outer surface of the tip of the male die portion. Subsequently, the workpiece is subjected to pressure by a compound male die which includes a central male die portion and an outer male die portion. The outer male die portion is forced against the workpiece to form a flange or rim in the cup-shaped housing by causing metal flow radially outward from the workpiece. The flow of ductile metal in the workpiece results in a finished part of the desired configuration being produced from the slug of copper metal without the necessity of machining, thereby eliminating the cost of machining operations and the accompanying material scrap loss.

U.S. Pat. No. 4,071,947, issued Feb. 7, 1978, to Nippert, discloses a method of making a bimetal resistance welding electrode. A bimetal slug or billet of copper alloy material and dispersion strengthened copper material is initially brazed together and, subsequently, a hollow cylindrical electrode shape is formed by means of a back-extrusion process in which a male extrusion punch is advanced downwardly into a containing die, causing the billet to extrude backward along the outside of the punch. While this type of extrusion process may be used to form an elongated cylindrical article having a central cylindrical recess or cavity, it should be noted that the lower surface of the extruded electrode in the Nippert '947 patent is substantially flat, and therefore permits the electrode to be ejected by a knockout punch.

A problem, however, develops where an elongated cylindrical article having both upper and lower cylindrical recesses is to be formed. If the lower cylindrical recess has a relatively large inside diameter such that the article wall thickness is relatively small, the bottom annular surface of the article presents little contact surface in the die for ejection of the extruded part by a knockout punch. Additionally, if the article wall is sufficiently thin, the wall may tend to buckle as the knockout punch is raised during ejection of the article from the die, thus ruining the extruded part.

Thus, it may be seen that there is a need for a method and apparatus for forming a thin walled cylindrical article defining a cylindrical recess, in which the article is forward extruded in a die and subsequently ejected successfully from the die without damage to the article.

SUMMARY OF THE INVENTION

A method of making an elongated substantially cylindrical article from a billet of ductile metal, said article having a substantially cylindrical recess therein concentric with the outer cylindrical surface of the article, includes the steps of:

(a) forming a billet of ductile metal, at least one portion of the billet having an outside diameter substantially equal to the outside diameter of the elongated cylindrical article;

(b) placing the billet of ductile metal in a movable die, the one portion of the billet being received into a lower die cavity having an inside diameter substantially equal to the outside diameter of the elongated cylindrical article;

(c) moving the billet and the movable die downward from an initial position by means of an extrusion drive member, which member contacts the top of the billet and applies a downward force thereto;

(d) forward extruding the billet over a stationary punch within the lower die cavity so as to form the elongated cylindrical article, the stationary punch having an upper portion with an outside diameter substantially equal to the inside diameter of the substantially cylindrical recess and a lower portion extending completely across the lower die cavity;

(e) raising the extrusion drive member out of contact with the elongated cylindrical article;

and (f) ejecting the article from the movable die section by raising the stationary punch with respect to the movable die.

The step of raising the extrusion drive member out of contact with the elongated cylindrical article may include the step of raising the movable die and the stationary punch with the extrusion drive member until the movable die reaches its initial position.

The step of ejecting the article from the movable die may include the step of raising the stationary punch after the movable die has reached its initial position.

The step of raising the movable die may include the step of applying an upwardly directed spring force thereto, urging the die toward its initial position.

The apparatus for forming the elongated, substantially cylindrical article includes an extrusion die having a stationary die section which defines an opening therein, and a movable die section which is movable vertically within the opening defined by the stationary die section. The movable die section defines a billet receiving opening which is substantially cylindrical and of an inner diameter substantially equal to the outside diameter of the article. The extrusion die further includes spring means for urging the movable die section upward into an initial position. A stationary punch extends into the billet receiving opening from beneath the movable die section and is connected to a knockout cylinder means. The stationary punch defines an upper portion of an outer diameter substantially equal to the inner diameter of the substantially cylindrical recess and a lower portion of an outer diameter substantially equal to the inner diameter of the billet receiving opening. An extrusion drive member is positioned above the billet receiving opening and is movable downward into the billet receiving opening to contact a billet of ductile metal therein and to move the billet and the movable die section downward. Downward movement of the billet and the movable die section causes the billet to be forward extruded over the upper portion of the stationary punch, thereby producing the elongated substantially cylindrical article.

The spring means may comprise a plurality of compression springs positioned in the opening of the stationary die section and contacting the bottom of the movable die section so as to urge the movable die section upward. The compression springs may be received within opposing recesses in the stationary and movable die sections.

The stationary die section may include means for contacting the movable die section when the movable die section has been raised into its initial position so as to prevent further upward movement thereof.

The movable die section may define a billet receiving opening having an upper portion of a first inner diameter and a lower portion of a second inner diameter. The second inner diameter is less than the first inner diameter. The upper portion of the stationary punch may include sections of differing outer diameters.

Accordingly, it is an object of the present invention to provide a method of making an elongated cylindrical article having a cylindrical recess therein by cold forming a ductile metal material; to provide such a method in which the article is forward extruded in a die over a bottom forming punch; to provide such a method in which the punch remains stationary while a movable die section and a billet of ductile metal are moved downward by an extrusion drive member; to provide such a method in which the billet is initially formed with a recess in its upper end and in which the extrusion drive member is a finish punch having a portion of reduced diameter which is received within the recess in the upper end of the billet; and to provide such a method in which the finish part is ejected from the die by upward movement of the bottom forming punch.

Other objects and advantages of the invention will be apparent from the following description, the accompanying drawings and the appended claims.

DETAILED DESCRIPTION OF THE PREFERRED EMBODIMENT

Figure 1:
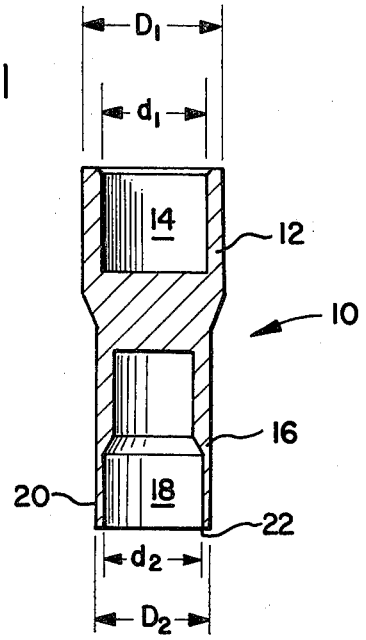
FIG. 1 is a sectional view of an electrical connector formed by the method and apparatus of the present invention.

FIG. 1 shows an electrical connector 10 of the type which may be made by means of the method and apparatus of the present invention. Connector 10 has a first, upper cylindrical portion 12 of a first outside diameter D1 and defines a first cylindrical recess 14 therein of a diameter $d_2$. The connector has a second, lower cylindrical portion 16 having a second outside diameter $D_2$ and defining a second cylindrical recess 18. Recess 18 has a second diameter $d_2$ adjacent the bottom of the connector 10. The second outside diameter $D_2$ is less than the first outside diameter $D_1$.

Such a connector may typically be used in a semiconductor component to provide a means of electrically connecting conductors of differing sizes. The ends of the conductors may be inserted into recesses 14 and 18 and brazed, soldered or crimped therein. In one semiconductor component construction, the bottom portion of the connector 10 is brazed into a surrounding ceramic insulator. For this reason, the inside diameter $d_2$ is made relatively large so as to produce a very thin wall for the connector in the region 20. As a result, the thermal expansion experienced by this portion of the connector 10 during the brazing operation is not sufficient to crack the ceramic insulator during the brazing operation.

As discussed previously, the problem presented with manufacturing such a thin walled connector, or other similar thin walled article, by an extrusion process is that by reason of the portion 16 having an outside diameter less than the portion 12 the connector 10 must be extruded with the portion 16 oriented downward in the extrusion die. If a simple knockout sleeve, in contact only with the annular surface 22, were to be raised within the die so as to eject the connector 10, it is quite possible that the connector would be damaged due to the relatively large compressive forces on the thin walled portion 20. In the past, therefore, it has been common to extrude a thick-walled part generally similar in appearance to the connector of FIG. 1, but having an outside diameter $D_1$ along its entire length. Subsequently, the exterior of the lower portion of the part has been machined down to a diameter to equal $D_2$. It will be appreciated that such a machining operation adds to the cost of the manufactured connector by increasing its labor content, as well as by increasing the amount of scrap produced in making the connector.

Figure 2A:
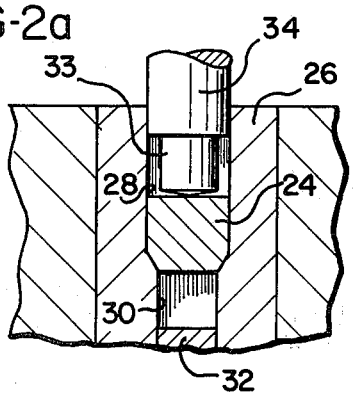
FIGS. 2(*a*) and 2(*b*) are sectional views of a first die and punch, illustrating the formation of an intermediate billet.
Figure 2B:
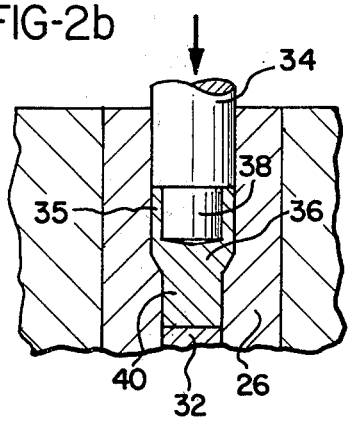
Figure 3B:
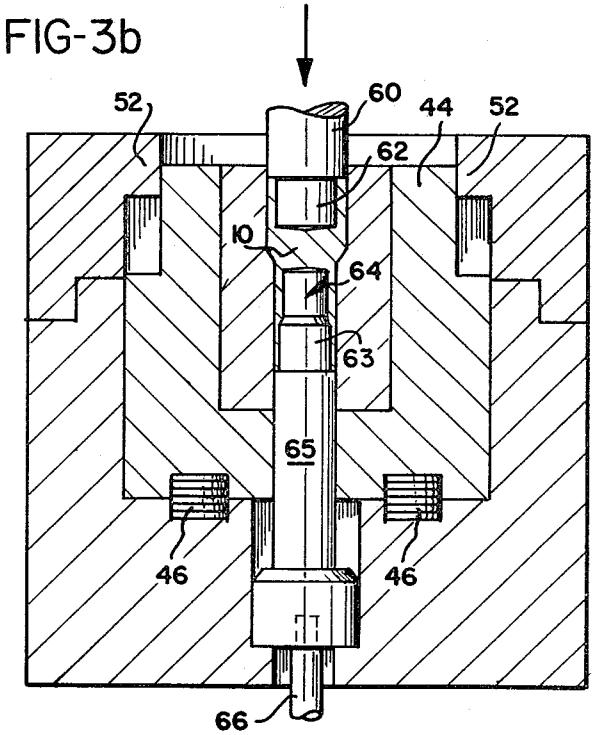
FIGS. 3(*a*), 3(*b*), 3(*c*), and 3(*d*) are sectional views of a second die, finish punch, stationary punch, and with the intermediate billet positioned in the die, illustrating the formation of the electrical connector and the ejection of the connector from the die.
Figure 3A:
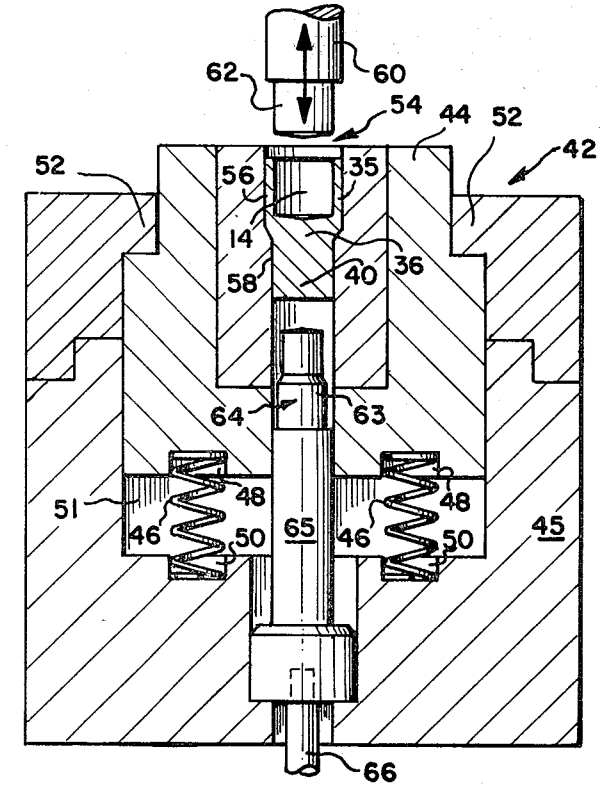
Figure 3D:
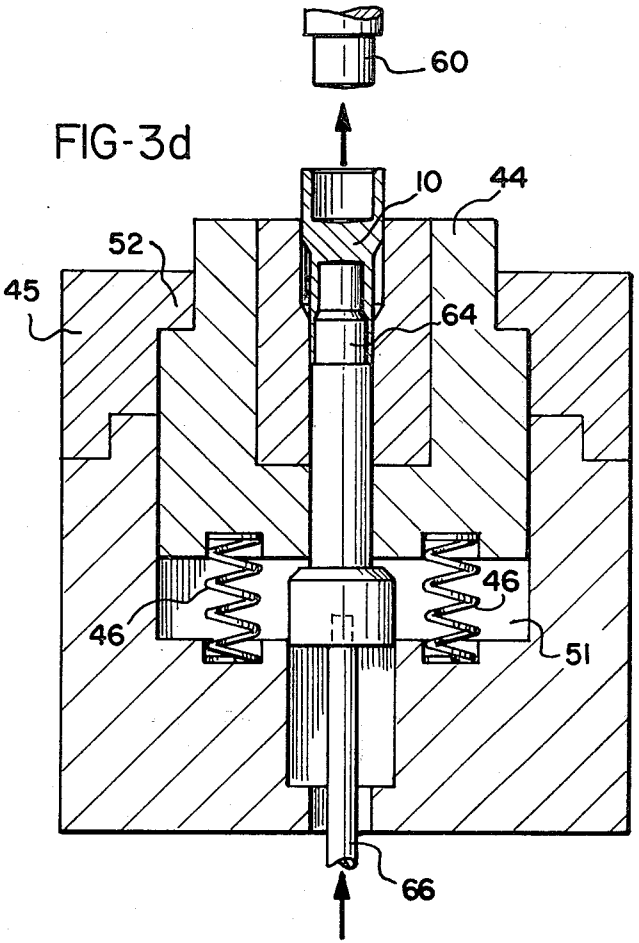
Figure 3C:
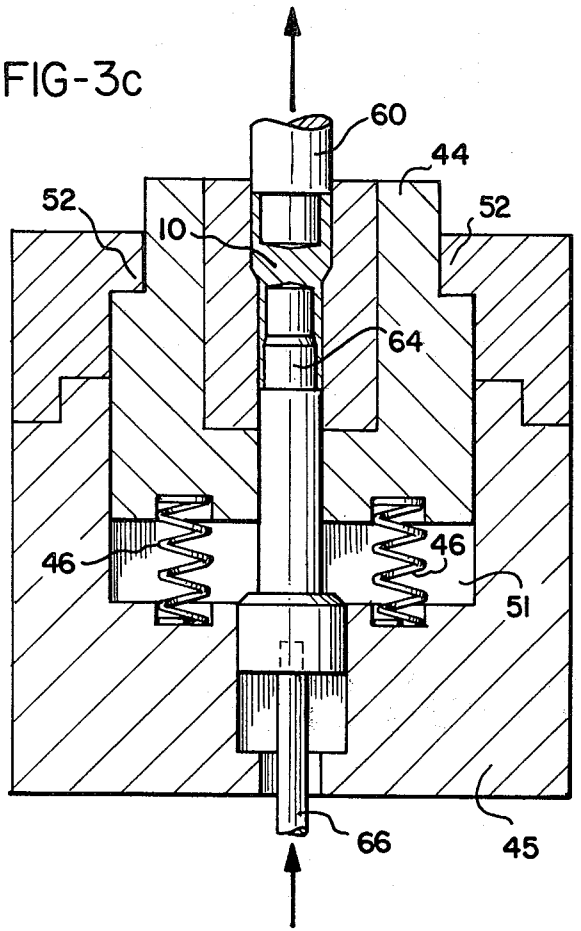

FIGS. 2(*a*), 2(*b*), and 3(*a*)–3(*d*) illustrate a method and apparatus for forming the electrical connector according to the present invention. As shown in FIG. 2(*a*), a cylindrical billet 24 of ductile metal, such as copper or a copper alloy, is initially formed by any one of a number of operations, such as for example by a simple upsetting operation. The cylindrical billet 24 has an outer diameter substantially equal to the first diameter $D_1$ of the electrical connector 10 and may be beveled around its bottom surface.

The billet 24 is placed in a first die 26. Die 26 has an upper region 28 of an inside diameter D1 and a lower region 30 of a reduced inside diameter D2. A stationary knockout pin 32 is positioned in the bottom of the die 26. A punch 34 is lowered into the die cavity, as shown in FIG. 2(*b*) so as to form a first cylindrical position 35 of an intermediate billet 36 by back extruding the cylindrical billet 24 around the tip 38 of the punch 34. Simultaneously, the billet 24 is forward extruded into the lower portion 30 of the die 26 to form a cylindrical portion 40 of reduced diameter. Portion 40, therefore, has an outside diameter approximately equal to the second diameter $D_2$.

Next, as shown in FIG. 3(*a*), the intermediate billet 36 is placed in a second die 42, which includes a movable die section 44 and a stationary die section 45. Die section 44 is spring biased upward into an initial position, shown in FIG. 3(*a*), by means of compression springs 46 which are seated within recesses 48 in movable die section 44 and opposing recesses 50 in the stationary die section 45 of the second die. The movable die section 44 is free to move vertically within the opening 51 defined by stationary die section 45. The stationary die section 45 includes a shoulder 52 which provides a means for contacting the movable die section to prevent upward movement beyond the initial position.

The movable die section 44 defines a billet receiving die opening 54 into which the intermediate billet is placed. An upper portion 56 of the die opening has an inside diameter substantially equal to the first diameter $D_1$ and a lower portion 58 of the die opening has an inside diameter substantially equal to the second diameter $D_2$. The first cylindrical portion 35 of the intermediate billet 36 which will ultimately form the first cylindrical portion 12 (FIG. 1) of the connector is positioned in the upper portion 56 of the die and the cylindrical portion 40 of reduced diameter of intermediate billet 36 is positioned in the lower portion 58 of the die.

An extrusion drive member, comprising finish punch 60, is then lowered, as shown in FIG. 3(*b*) such that the tip portion 62 of the punch 60 extends into recess 14 of the intermediate billet. The finish punch 60 applies pressure to the movable die section 44 through the intermediate billet 36, moving the intermediate billet 36 and the movable die section 44 downward, as shown in FIG. 3(*b*). This downward movement of the section 44 forces the portion 40 of the intermediate billet 36 over an upper portion 63 of a stationary punch 64 which is positioned within the die opening 54. The portion 40 is forward extruded over the portion 63, thereby forming the second cylindrical portion 16 (FIG. 1) of the connector 10. It should be noted that the shape of the portion 63 is precisely that desired for the recess 18 of the connector and may therefore include sections of differing diameters, and that the punch 64 further includes a lower portion 65 which extends completely across the die cavity 54.

Next, the finish punch 60 is raised, as shown in FIG. 3(*c*), and, as a consequence, compression springs 46 raise the movable die section 44 and the finished connector 10 simultaneously therewith to the initial position of the movable die section. The stationary punch 64, which is attached to knockout cylindrical shaft 66, is also raised at the same time.

The finish punch 60 is then retracted out of contact with the finished connector 10. Finally, the stationary punch 64 is raised further, as shown in FIG. 3(*d*), overcoming the frictional engagement between the exterior surface of the connector 10 and the interior surface of the movable die section 44. Connector 10 is thus ejected from the second die and the article forming method is completed.

Several features of the method of the present invention should be pointed out. First, the frictional engagement between the exterior surface of the finished connector and the inner surface of the moving die section is overcome by utilizing a stationary punch 64 which is raised with respect to the die section 44 and which contacts all of the available lower connector surfaces including the bottom annular surface 22 (FIG. 1) and the side and upper surfaces of the recess 18 (FIG. 1). As a consequence, the relatively thin-walled connector is not subject to undue compressional forces which might otherwise destroy the connector during the ejection process.

Second, by forming the recesses 14 and 18 in a two-step extrusion process, it is possible to limit the volume of metal flow that occurs during each of the extrusion operations. It should be noted that during the second extrusion operation, shown in FIGS. 3(*a*)–(*d*), only the shape of the lower portion 16 of the connector 10 is changed, with the upper portion 12 having already been formed in the previous extrusion process shown in FIGS. 2(*a*) and (*b*). Additionally, the forward extrusion process of FIG. 3(*b*) utilizes only metal from the portion 40 of reduced diameter of the intermediate billet 36, thus also limiting metal flow.

It will be appreciated that the method and apparatus of the present invention have wide utility in forming articles of ductile metal. By the phrase "ductile metal" it is intended to refer to copper, copper alloys, and other metals and metal alloys having sufficient ductility to be extruded.

While the method herein described and the apparatus for carrying out this method constitute preferred embodiments of the invention, it is to be understood that the invention is not limited to this precise method and apparatus and that changes may be made therein without departing from the scope of the invention.

What is claimed is:

1. A method of forming an electrical connector having a first cylindrical portion with a first outside diameter, said first cylindrical portion defining a first cylindrical recess therein, and a second cylindrical portion with a second outside diameter, said second cylindrical portion defining a second cylindrical recess therein, said second outside diameter being less than said first outside diameter, comprising the steps of:

(a) forming a cylindrical billet of ductile metal, said cylindrical billet having an outer diameter substantially equal to said first diameter, (b) placing said billet in a first die and forming an intermediate billet by back extruding said first portion of said connector over a punch cooperating with said die, while forward extruding said billet in said die to form a portion of reduced diameter, said portion of reduced diameter having an outside diameter approximately equal to said second outside diameter, (c) placing said intermediate billet in a movable die section, said movable die section have an upper portion of an inside diameter substantially equal to said first diameter and a lower portion of an inside diameter substantially equal to said second diameter, said first cylindrical portion of said connector being positioned in said upper portion of said die and said portion of reduced diameter being positioned in said lower portion of said die, (d) moving said intermediate billet and said movable die section downward from an initial position by means of a finish punch, said finish punch contacting said intermediate billet and being received within said first cylindrical recess, downward movement of said movable die section forcing said portion of reduced diameter over a stationary punch within said die such that said portion of reduced diameter is forward extruded, thereby forming said second cylindrical portion and said second cylindrical recess therein and producing said connector, (e) retracting said finish punch from said connector, and (f) ejecting said connector from said movable die section by raising said stationary punch with respect to said movable die section.

2. The method of claim 1 in which the step of retracting said finish punch from said connector includes the step of moving said movable die section and said stationary punch upward with said finish punch until said movable die section reaches said initial position.

3. The method of claim 2 in which the step of ejecting said connector from said movable die section includes the step of raising said stationary punch after said movable die section has reached said initial position.

4. The method of claim 3 in which the step of moving said movable die section upward includes the step of providing a spring force to said movable die section, whereby said movable die section is spring-biased toward said initial position.

5. A method of making an elongated substantially cylindrical article from a billet of ductile metal, said article having a substantially cylindrical recess therein concentric with the outer cylindrical surface of said article, comprising the steps of:

forming a billet of ductile metal, at least one portion of said billet having an outside diameter substantially equal to the outside diameter of said elongated cylindrical article, placing said billet of ductile metal in a movable die, said one portion of said billet being received into a lower cavity of said die having an inside diameter substantially equal to said outside diameter of said elongated cylindrical article, moving said billet and said movable die downward from an initial position by means of an extrusion drive member, which member contacts the top of said billet and applies a downward force thereto, forward extruding said billet over a stationary punch within said lower die cavity so as to form said elongated cylindrical article, said stationary punch having an upper portion with an outside diameter substantially equal to the inside diameter of said substantially cylindrical recess and a lower portion extending completely across said lower die cavity, raising said extrusion drive member out of contact with said elongated cylindrical article, and ejecting said article from said movable die by raising said stationary punch with respect to said movable die.

6. The method of claim 5 in which the step of raising said extrusion drive member out of contact with said elongated cylindrical article includes the step of raising said movable die and said stationary punch with said extrusion drive member until said movable die reaches said initial position.

7. The method of claim 6 in which the step of ejecting said article from said movable die includes the step of raising said stationary punch after said movable die has reached said initial position.

8. The method of claim 7 in which the step of raising said movable die includes the step of applying an upwardly directed spring force thereto, urging said die toward said initial position.

9. Apparatus for forming an elongated substantially cylindrical article from a billet of ductile metal, said article having a substantially cylindrical recess therein concentric with the outer cylindrical surface of said article, comprising:

an extrusion die including a stationary die section defining an opening therein, a movable die section defining a billet receiving opening which is substantially cylindrical and of an inner diameter substantially equal to the outside diameter of said article, said movable die section being movable vertically within said opening defined by said stationary die section, and spring means for urging said movable die section upward to an initial position, a stationary punch extending into said billet receiving opening from beneath said movable die section and connected to knockout cylinder means, said stationary punch defining an upper portion of an outer diameter substantially equal to the inner diameter of said substantially cylindrical recess and a lower portion of an outer diameter substantially equal to the inner diameter of said billet receiving opening, and an extrusion drive member positioned above said billet receiving opening and movable downward into said billet receiving opening to contact a billet of ductile metal therein and to move said billet and said movable die section downward, causing said billet to be forward extruded over the upper portion of said stationary punch, thereby producing said elongated substantially cylindrical article.

10. The apparatus of claim 9 in which said spring means comprises a plurality of compression springs positioned in said opening of said stationary die section and contacting the bottom of said movable die section so as to urge said movable die section upward.

11. The apparatus of claim 10 in which said compression springs are received within opposing recesses in said stationary and movable die sections.

12. The apparatus of claim 9 in which said stationary die section includes means for contacting said movable die section when said movable die section has been raised into said initial position so as to prevent further upward movement thereof.

13. The apparatus of claim 9 in which said movable die section defines a billet receiving opening having an upper portion of a first inner diameter and a lower portion of a second inner diameter, said second inner diameter being less than said first inner diameter.

14. The apparatus of claim 9 in which said upper portion of said stationary punch includes sections of differing outer diameters.

* * * * *